US007766128B2

(12) United States Patent
Takeuchi et al.

(10) Patent No.: US 7,766,128 B2
(45) Date of Patent: Aug. 3, 2010

(54) METHOD FOR INSPECTING OPERATION OF ACTUATOR AND ACTUATOR OPERATION INSPECTOR

(75) Inventors: Toshie Takeuchi, Tokyo (JP); Kenji Shimohata, Tokyo (JP); Tae Hyun Kim, Tokyo (JP); Hiroshi Kigawa, Tokyo (JP); Tatsuo Matsuoka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 924 days.

(21) Appl. No.: 10/578,182

(22) PCT Filed: Mar. 29, 2004

(86) PCT No.: PCT/JP2004/004447

§ 371 (c)(1),
(2), (4) Date: May 4, 2006

(87) PCT Pub. No.: WO2005/092767

PCT Pub. Date: Oct. 6, 2005

(65) Prior Publication Data

US 2007/0000733 A1 Jan. 4, 2007

(51) Int. Cl.
*B66B 3/00* (2006.01)

(52) U.S. Cl. ..... 187/393; 187/314; 187/351; 187/391; 324/207.11

(58) Field of Classification Search ..... 187/314, 187/351, 391, 393; 251/129.15; 324/207.11; 361/139

See application file for complete search history.

(56) References Cited

U.S. PATENT DOCUMENTS 5,161,083 A * 11/1992 Mohler et al. ..... 361/143
5,241,292 A * 8/1993 Bjorknas et al. ..... 335/256
5,313,161 A * 5/1994 Miyazawa et al. ..... 324/207.16
5,321,216 A * 6/1994 Jamieson et al. ..... 187/280
5,692,463 A * 12/1997 Liang et al. ..... 123/90.11
5,717,174 A * 2/1998 Ramos ..... 187/288
6,076,490 A * 6/2000 Esch et al. ..... 123/90.11

(Continued)

FOREIGN PATENT DOCUMENTS

GB 2 350 724 12/2000

(Continued)

OTHER PUBLICATIONS

Machine traslation of JP 08061405 A.*

*Primary Examiner*—Walter Benson
*Assistant Examiner*—Kawing Chan
(74) *Attorney, Agent, or Firm*—Oblon, Spivak, McClelland, Maier & Neustadt, L.L.P.

(57) ABSTRACT

An actuator used in a safety stop device for an elevator has: a movable portion displaceable between an actuation position where the safety stop device for the elevator is actuated and a normal position where the actuation of the safety stop device is released; and an electromagnetic coil for displacing the movable portion when a current flows through the electromagnetic coil. A device for inspecting operation of the actuator has a feeder circuit for supplying an amount of electricity required for a semi-operation which is less than that required for a full operation for displacing the movable portion from the normal position and the actuation position to the electromagnetic coil.

14 Claims, 11 Drawing Sheets

U.S. PATENT DOCUMENTS

| | | | | |
|---|---|---|---|---|
| 6,390,036 | B1 * | 5/2002 | Yuuki | 123/90.11 |
| 2002/0044403 | A1 * | 4/2002 | Takeuchi et al. | 361/152 |
| 2003/0107017 | A1 * | 6/2003 | Mianzo et al. | 251/129.16 |
| 2004/0011979 | A1 * | 1/2004 | Seo et al. | 251/129.1 |

FOREIGN PATENT DOCUMENTS

| | | | |
|---|---|---|---|
| JP | 52-123052 | | 10/1977 |
| JP | 29754/1983 | | 2/1983 |
| JP | 08061405 | A * | 3/1996 |
| JP | 11-29280 | | 2/1999 |
| JP | 2001-80840 | | 3/2001 |
| JP | 2003-59384 | | 2/2003 |

* cited by examiner

METHOD FOR INSPECTING OPERATION OF ACTUATOR AND ACTUATOR OPERATION INSPECTOR

TECHNICAL FIELD

The present invention relates to an actuator operation inspecting method and an actuator operation inspecting device for inspecting the operation of an actuator for actuating a safety stop device for an elevator.

BACKGROUND ART

In order to prevent a car from falling, a safety stop device is used in a conventional elevator. JP 2001-80840 A discloses an elevator safety stop device for pressing a wedge against a guide rail for guiding a car to stop the car from falling. A conventional safety stop device for an elevator is operated by an actuator adapted to mechanically cooperate with a speed governor for detecting abnormalities in the raising and lowering speed of a car. In such a safety stop device for an elevator, in order to enhance the reliability of its operation, it is necessary to frequently check the operation of the actuator in advance.

However, when the operation for pressing the wedge against the car guide rail is carried out frequently, the wedge is worn away, shortening the life of the wedge.

DISCLOSURE OF THE INVENTION

The present invention has been made in order to solve the problem as described above, and it is therefore an object of the present invention to obtain an actuator operation inspecting method and an actuator operation inspecting device which are capable of lengthening the life of a wedge and of enhancing the reliability of an operation.

According to the present invention, an method of inspecting actuator operation for an actuator having a movable portion displaceable between an actuation position where a safety stop device of an elevator is actuated and a normal position where the actuation of the safety stop device is released, includes: displacing the movable portion between the normal position and a semi-operation portion located between the normal position and the actuation position.

BEST MODE FOR CARRYING OUT THE INVENTION

Hereinafter, preferred embodiments of the present invention will be described with reference to the drawings.

Embodiment 1

Figure 1:
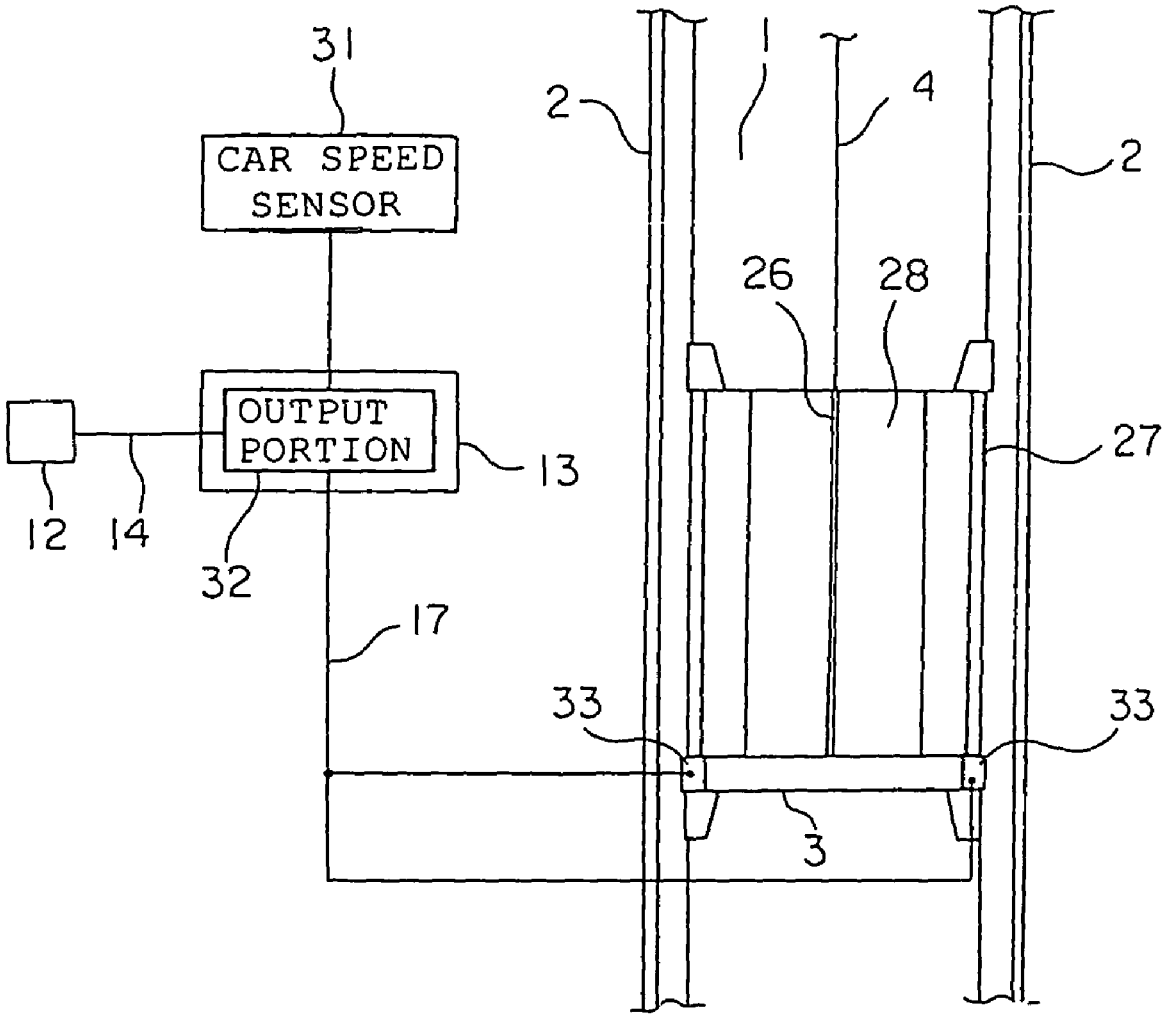
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a pair of car guide rails 2 are arranged within a hoistway 1. A car 3 is guided by the car guide rails 2 as it is raised and lowered in the hoistway 1. Arranged at the upper end portion of the hoistway 1 is a hoisting machine (not shown) for raising and lowering the car 3 and a counterweight (not shown). A main rope 4 is wound around a drive sheave of the hoisting machine. The car 3 and the counterweight are suspended in the hoistway 1 by means of the main rope 4. Mounted to the car 3 are a pair of safety devices 33 opposed to the respective guide rails 2 and serving as braking means. The safety devices 33 are arranged on the underside of the car 3. Braking is applied to the car 3 upon actuating the safety devices 33.

The car 3 has a car main body 27 provided with a car entrance 26, and a car door 28 that opens and closes the car entrance 26. Provided in the hoistway 1 is a car speed sensor 31 serving as car speed detecting means for detecting the speed of the car 3, and a control panel 13 that controls the drive of an elevator.

Mounted inside the control panel 13 is an output portion 32 electrically connected to the car speed sensor 31. The battery 12 is connected to the output portion 32 through the power supply cable 14. Electric power used for detecting the speed of the car 3 is supplied from the output portion 32 to the car speed sensor 31. The output portion 32 is input with a speed detection signal from the car speed sensor 31.

A control cable (movable cable) is connected between the car 3 and the control panel 13. The control cable includes, in addition to multiple power lines and signal lines, an emergency stop wiring 17 electrically connected between the control panel 13 and each safety device 33.

A first overspeed which is set to be higher than a normal operating speed of the car 3 and a second overspeed which is set to be higher than the first overspeed are set in the output portion 32. The output portion 32 actuates a braking device of the hoisting machine when the raising/lowering speed of the car 3 reaches the first overspeed (set overspeed), and outputs an actuation signal that is actuating electric power to the safety stop device 33 when the raising/lowering speed of the car 3 reaches the second overspeed. The safety stop device 33 is actuated by receiving the input of the actuation signal.

Figure 2:
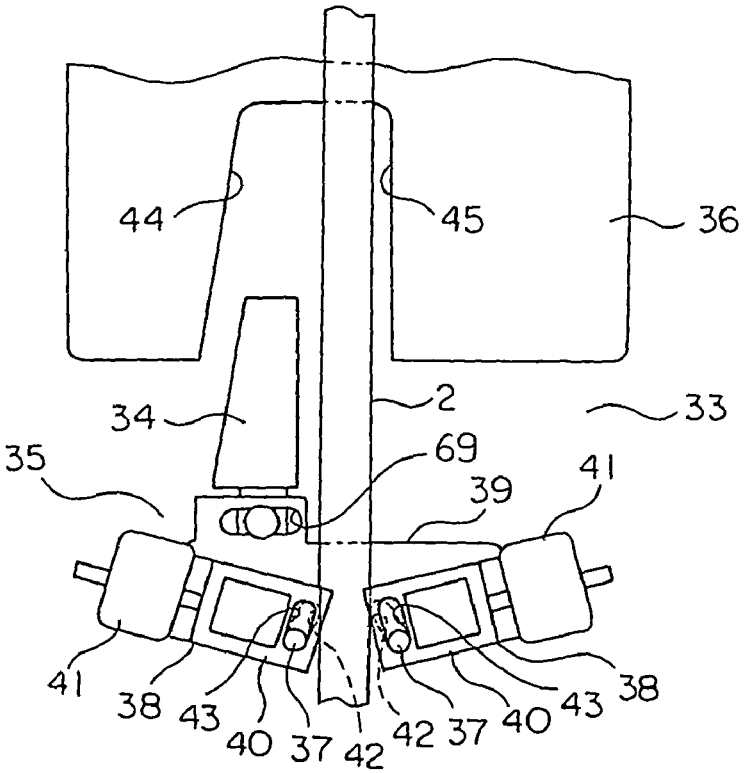
FIG. 2 is a front view showing the safety stop device shown in FIG. 1.
Figure 3:
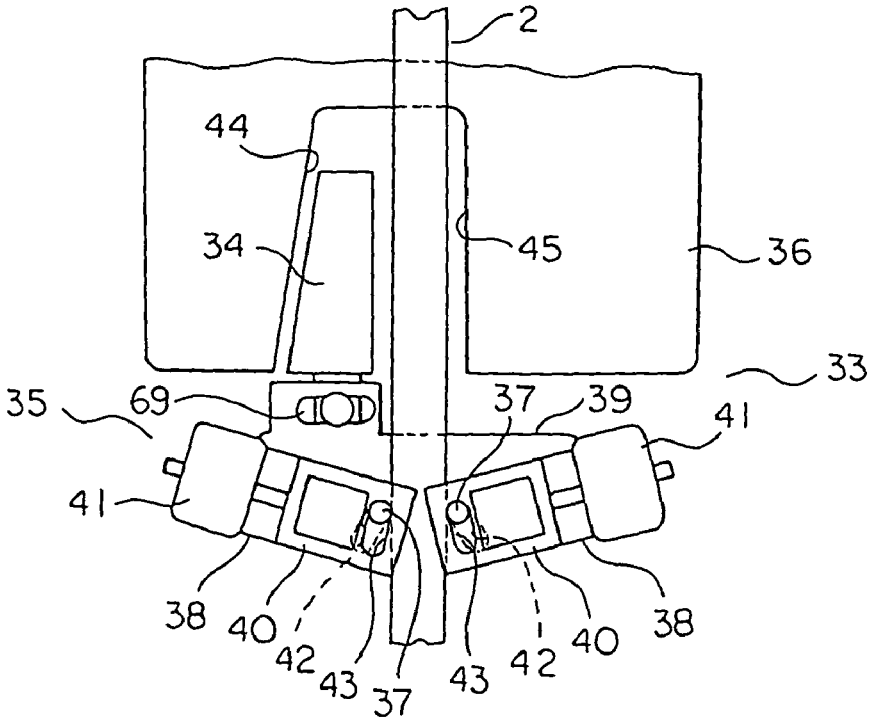
FIG. 3 is a front view of the safety stop device shown in FIG. 2 during the actuation phase.

FIG. 2 is a front view showing the safety stop device 33 shown in FIG. 1, and FIG. 3 is a front view of the safety stop device 33 shown in FIG. 2 during the actuation phase. In the drawings, the safety stop device 33 has a wedge 34 serving as a braking member which can be moved into and away from contact with the car guide rail 2, a support mechanism portion 35 connected to a lower portion of the wedge 34, and a guide portion 36 which is disposed above the wedge 34 and fixed to the car 3. The wedge 34 and the support mechanism portion 35 are provided so as to be vertically movable with respect to the guide portion 36. The wedge 34 is guided in a direction to come into contact with the car guide rail 2 of the guide portion 36 by its upward displacement with respect to the guide portion 36, i.e., its displacement toward the guide portion 36 side.

The support mechanism portion 35 has cylindrical contact portions 37 which can be moved into and away from contact with the car guide rail 2, actuation mechanisms 38 for displacing the respective contact portions 37 in a direction along which the respective contact portions 37 are moved into and away from contact with the car guide rail 2, and a support portion 39 for supporting the contact portions 37 and the actuation mechanisms 38. The contact portion 37 is lighter than the wedge 34 so that it can be readily displaced by the actuation mechanism 38. The actuation mechanism 38 has a contact portion mounting member 40 which can make the reciprocating displacement between a contact position where the contact portion 37 is held in contact with the car guide rail 2 and a separated position where the contact portion 37 is separated away from the car guide rail 2, and an actuator 41 for displacing the contact portion mounting member 40.

The support portion 39 and the contact portion mounting member 40 are provided with a support guide hole 42 and a movable guide hole 43, respectively. The inclination angles of the support guide hole 42 and the movable guide hole 43 with respect to the car guide rail 2 are different from each other. The contact portion 37 is slidably fitted in the support guide hole 42 and the movable guide hole 43. The contact portion 37 slides within the movable guide hole 43 according to the reciprocating displacement of the contact portion mounting member 40, and is displaced along the longitudinal direction of the support guide hole 42. As a result, the contact portion 37 is moved into and away from contact with the car guide rail 2 at an appropriate angle. When the contact portion 37 comes into contact with the car guide rail 2 as the car 3 descends, braking is applied to the wedge 34 and the support mechanism portion 35, displacing them toward the guide portion 36 side.

Mounted on the upperside of the support portion 39 is a horizontal guide hole 69 extending in the horizontal direction. The wedge 34 is slidably fitted in the horizontal guide hole 69. That is, the wedge 34 is capable of reciprocating displacement in the horizontal direction with respect to the support portion 39.

The guide portion 36 has an inclined surface 44 and a contact surface 45 which are arranged so as to sandwich the car guide rail 2 therebetween. The inclined surface 44 is inclined with respect to the car guide rail 2 such that the distance between it and the car guide rail 2 decreases with increasing proximity to its upper portion. The contact surface 45 is capable of moving into and away from contact with the car guide rail 2. As the wedge 34 and the support mechanism portion 35 are displaced upward with respect to the guide portion 36, the wedge 34 is displaced along the inclined surface 44. As a result, the wedge 34 and the contact surface 45 are displaced so as to approach each other, and the car guide rail 2 becomes lodged between the wedge 34 and the contact surface 45.

Figure 4:
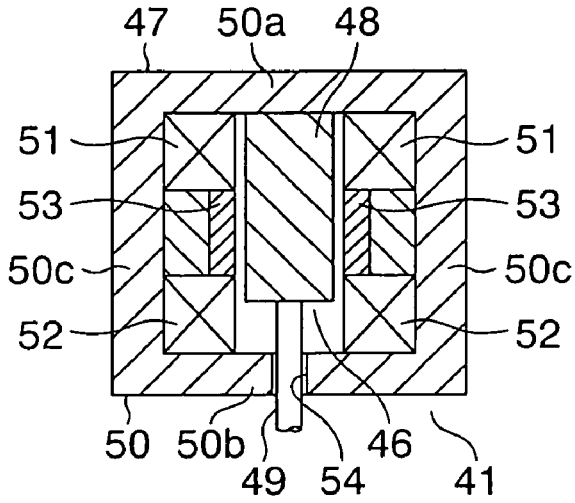
FIG. 4 is a schematic cross sectional view showing the actuator 41 shown in FIG. 2.
Figure 5:
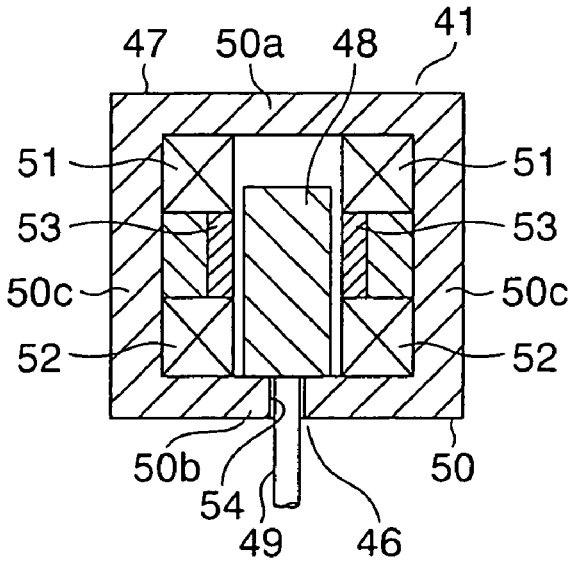
FIG. 5 is a schematic cross sectional view showing a state when the movable iron core 48 shown in FIG. 4 is located in the actuation position.

FIG. 4 is a schematic cross sectional view showing the actuator 41 shown in FIG. 2. In addition, FIG. 5 is a schematic cross sectional view showing a state when the movable iron core 48 shown in FIG. 4 is located in the actuation position. In the drawings, the actuator 41 has a connection portion 46 connected to the contact portion mounting member 40 (FIG. 2), and a driving portion 47 for displacing the connection portion 46.

The connection portion 46 has a movable iron core (movable portion) 48 accommodated within the driving portion 47, and a connection rod 49 extending from the movable iron core 48 to the outside of the driving portion 47 and fixed to the contact portion mounting member 40. Further, the movable iron core 48 can be displaced between an actuation position (FIG. 5) where the contact portion mounting member 40 is displaced to the contact position to actuate the safety stop device 33 and a normal position (FIG. 4) where the contact portion mounting member 40 is displaced to the separated position to release the actuation of the safety stop device 33.

The driving portion 47 has: a fixed iron core 50 which has a pair of regulating portions 50*a* and 50*b* for regulating the displacement of the movable iron core 48 and a sidewall portion 50*c* for connecting therethrough the regulating portions 50*a* and 50*b* to each other and which encloses the movable iron core 48; a first coil 51 accommodated within the fixed iron core 50 for displacing the movable iron core 48 in a direction along which the movable iron core 48 comes into contact with one regulating portion 50*a* by causing a current to flow through the first coil 51; a second coil 52 accommodated within the fixed iron core 50 for displacing the movable iron core 48 in a direction along which the movable iron core 48 comes into contact with the other regulating portion 50*b* by causing a current to flow through the second coil 52; and an annular permanent magnet 53 disposed between the first coil 51 and the second coil 52.

A through hole 54 through which the connection rod 49 is inserted is provided in the other regulating portion 50*b*. The movable iron core 48 abuts on one regulating portion 50*a* when being located in the normal position, and abuts on the other regulating portion 50*b* when being located in the actuation position.

The first coil 51 and the second coil 52 are annular electromagnetic coils surrounding the connection portion 46. In addition, the first coil 51 is disposed between the permanent magnet 53 and one regulating portion 50*a*, and the second coil 51 is disposed between the permanent magnet 53 and the other regulating portion 50*b*.

In a state in which the movable iron core 48 abuts on one regulating portion 50*a*, a space forming the magnetic resistance exists between the movable iron core 48 and the other regulating portion 50*b*. Hence, the amount of magnetic flux of the permanent magnet 53 becomes more on the first coil 51 side than on the second coil 52 side, and thus the movable iron core 48 is held in abutment with one regulating portion 50*a*.

Further, in a state in which the movable iron core 48 abuts on the other regulating portion 50*b*, a space forming the magnetic resistance exists between the movable iron core 48 and one regulating portion 50*a*. Hence, the amount of magnetic flux of the permanent magnet 53 becomes more on the second coil 52 side than on the first coil 51 side, and thus the movable iron core 48 is held in abutment with the other regulating portion 50*b*.

The electric power serving as the actuation signal from the output portion 32 is input to the second coil 52. Also, when receiving the actuation signal as its input, the second coil 52 generates a magnetic flux acting against the force for holding the state in which the movable iron core 48 abuts on one regulating portion 50*a*. Additionally, an electric power serving as a recovery signal from the output portion 32 is input to the first coil 51. Also, when receiving the recovery signal as its input, the first coil 51 generates a magnetic flux acting against the force for holding the state in which the movable iron core 48 abuts on the other regulating portion 50*b*.

Figure 6:
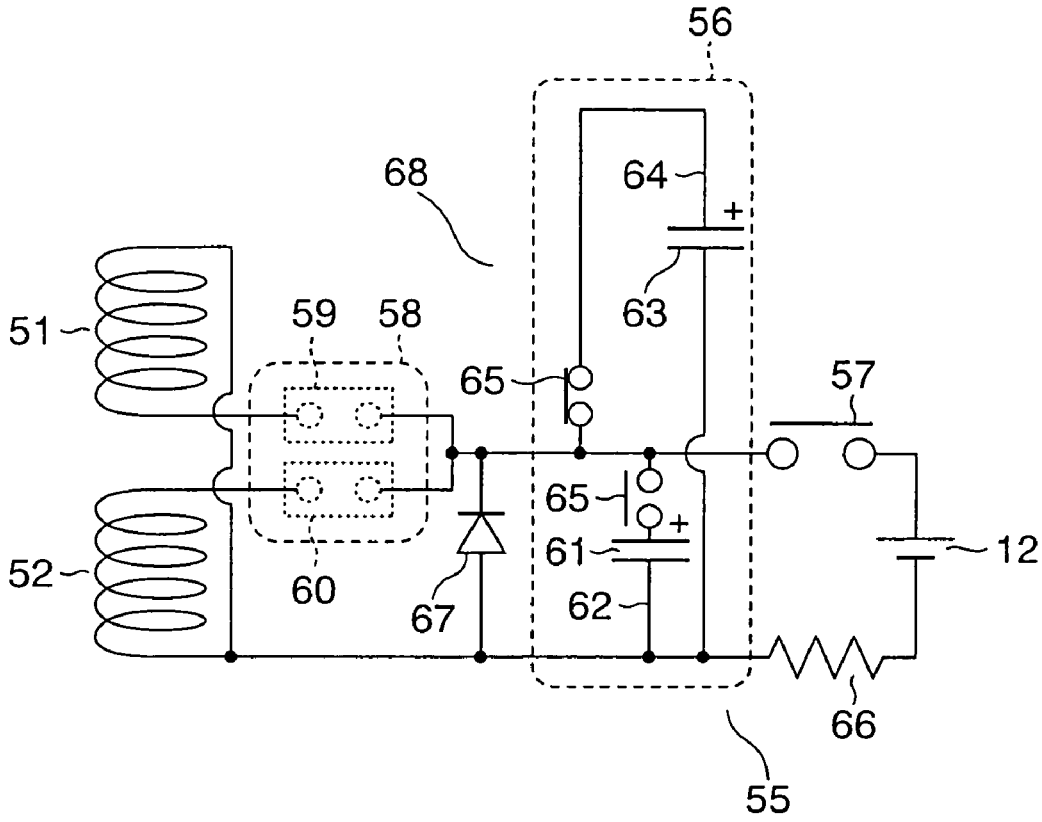
FIG. 6 is a circuit diagram showing a part of an internal circuit of the output portion shown in FIG. 1.

FIG. 6 is a circuit diagram showing a part of an internal circuit of the output portion 32 shown in FIG. 1. In FIG. 6, the output portion 32 is provided with a feeder circuit 55 for supplying electric power to the actuator 41. The feeder circuit 55 has: a charge portion 56 in which electric power from a battery 12 can be accumulated; a charge switch 57 for accumulating therethrough the electric power of the battery 12 in the charge portion 56; and a discharge switch 58 for selectively discharging the electric power accumulated in the charge portion 56 to the first coil 51 and the second coil 52. The movable iron core 48 (FIG. 4) is displaceable on the basis of the discharge of the electric power accumulated in the charge portion 56 to either the first coil 51 or the second coil 52.

The discharge switch 58 has a first semiconductor switch 59 for discharging therethrough the electric power accumulated in the charge portion 56 in the form of the recovery signal to the first coil 51, and a second semiconductor switch 60 for discharging therethrough the electric power accumulated in the charge portion 56 in the form of the actuation signal to the second coil 52.

The charge portion 56 has a normal mode feeder circuit 62 having a normal mode capacitor 61 serving as a charging capacitor, an inspection mode feeder circuit 64 having an inspection mode capacitor 63 serving as a charging capacitor, the charge capacity of which is set to be smaller than that of the normal mode capacitor 61, and a change-over switch 65 which can selectively change the normal mode feeder circuit 62 and the inspection mode feeder circuit 64 over to each other.

The normal mode capacitor 61 has a charge capacity with which the amount of electricity required for a full operation for displacing the movable iron core 48 from the normal position to the actuation position can be supplied to the second coil 52.

Figure 7:
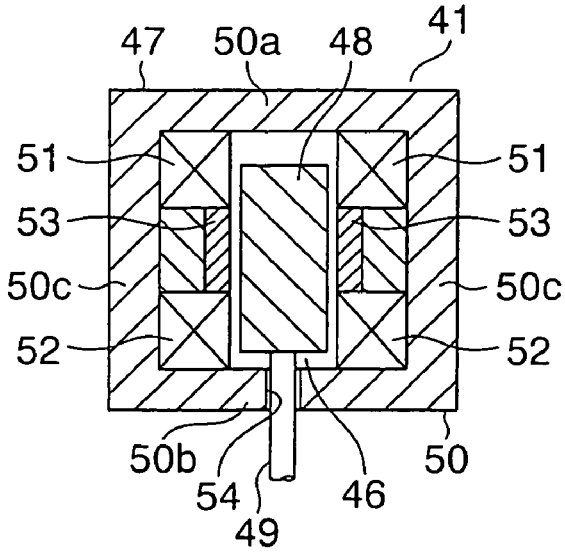
FIG. 7 is a cross sectional view showing a state in which the movable iron core shown in FIG. 4 is located in the actuation position.

The inspection mode capacitor 63, as shown in FIG. 7, has a charge capacity with which an amount of electricity required for a semi-operation for displacing the movable iron core 48 from the normal position to only a semi-operation position located between the actuation position and the normal position, i.e., an amount of electricity less than that required for the full operation can be supplied to the second coil 52. Moreover, when located in the semi-operation position, the movable iron core 48 is pulled back to the normal position by the magnetic force of the permanent magnet 53. That is, the semi-operation position is set as a position nearer the normal position than a neutral position where the magnetic force of the permanent magnet 53 acting on the movable iron core 48 balances out between the normal position and the actuation position. Further, the charge capacity of the inspection mode capacitor 63 is previously set on the basis of analysis or the like so that the movable iron core 48 can be displaced between the semi-operation position and the normal position.

The electric power from the battery 12 can be accumulated in the normal mode capacitor 61 through the change-over operation of the change-over switch 63 during the normal operation (normal mode) of the elevator, and can be accumulated in the inspection mode capacitor 61 through the change-over operation of the change-over switch 65 during the inspection operation (inspection mode) of the actuator 41.

Further, an internal resistor 66 and a diode 67 are provided within the feeder circuit 55. Also, an operation inspecting device 68 has an inspection mode feeder circuit 64.

Next, operation will be described. During normal operation, the contact portion mounting member 40 is located in the separated position, and the movable iron core 48 is located in the normal position. In this state, a space defined between the wedge 34 and the guide portion 36 is maintained, and thus the wedge 34 is separated away from the car guide rail 2. In addition, both the first semiconductor switch 59 and the second semiconductor switch 60 are in an OFF state. Moreover, during the normal operation, the mode of the normal mode feeder circuit 64 is set to the normal mode through the change-over switch 65, and thus the electric power from the battery 12 is accommodated in the normal mode capacitor 59.

When the speed detected by the car speed sensor 31 reaches the first overspeed, the braking device of the hoisting machine is actuated. Thereafter, if the speed of the car 3 continues to increase and the speed detected by the car speed sensor 31 reaches the second overspeed, the second semiconductor switch 60 is turned ON so that the electric power accumulated in the normal mode capacitor 61 is discharged in the form of the actuation signal to the second coil 52. That is, the actuation signal is output from the output portion 32 to each of the safety stop devices 33.

As a result, a magnetic flux is generated around the second coil 52 so that the movable iron core 48 is displaced in a direction approaching the other regulating portion 50*b*, i.e., displaced from the normal position to the actuation position (FIG. 5). As a result, the contact portion 37 comes into contact with the car guide rail 2 to be pressed against the guide rail 2 to brake the wedge 34 and the support mechanism portion 35 (FIG. 3). The movable iron core 48 is held in the actuation position to remain in abutment with the other regulating portion 50*b* by the magnetic force of the permanent magnet 53.

Since the car 3 and the guide portion 36 are lowered without being braked, the guide portion 36 is displaced to the side of the wedge 34 and the support mechanism portion 35 which are located below the guide portion 36. The wedge 34 is guided along an inclined surface 44 through this displacement so that the car guide rail 2 is held between the wedge 34 and the contact surface 45. The wedge 34 is further upwardly displaced through its contact to the car guide rail 2 to be wedged in between the car guide rail 2 and the inclined surface 44. As a result, a large frictional force is generated between the car guide rail 2, and the wedge 34 and the contact surface 45 to brake the car 3.

During the recovery phase, after the second semiconductor switch 60 is turned OFF and the electric power of the battery 12 is then accumulated in the normal mode capacitor 61 again, the first semiconductor switch 59 is turned ON. That is, the recovery signal is transmitted from the output portion 32 to each of the safety stop devices 33. As a result, the first coil 51 is charged with electricity so that the movable iron core 48 is displaced from the actuation position to the normal position. The car 3 is raised in this state, thereby releasing the pressing of the wedge 34 and the contact surface 45 against the car guide rail 2.

Next, a description will be given with respect to a procedure when the operation of the actuator 41 is inspected, i.e., a method of inspecting the operation of the actuator 41.

First, after the charge switch 57 is turned OFF, the first semiconductor switch 59 is turned ON to discharge the electric power accumulated in the normal mode capacitor 61.

After that, the connection to the battery 12 is changed from the normal mode feeder circuit 62 over to the inspection mode feeder circuit 64 by the change-over switches 65. After that, the charge switch 57 is turned ON to accumulate the electric power of the battery 12 in the inspection mode capacitor 63. After the charge switch is turned OFF, the second semiconductor switch 60 is turned ON to charge the second coil 52 with electricity, thereby displacing the movable iron core 48 between the normal position and the semi-operation position.

If the operation of the actuator 41 is normal, the movable iron core 48 is displaced from the normal position to the semi-operation position to be pulled back to the normal position again. The contact portion mounting member 40 and the contact portion 37 are smoothly displaced along with this operation. That is, the movable iron core 48, the contact portion mounting member 40, and the contact portion 37 are semi-operated normally.

If there is a malfunction in the operation of the actuator 41, the movable iron core 48, the contact portion mounting member 40, and the contact portion 37 do not make the normal semi-operation as described above. The presence or absence of a malfunction in the operation of the actuator 41 is checked in such a manner.

After completion of the inspection, the inspection mode is changed over to the normal mode by the change-over switches 65 to turn ON the charge switch 57, thereby accumulating the electric power of the battery 12 in the normal mode capacitor 61.

With such a method of inspecting the operation of the actuator 41 of the safety stop device 33 of the elevator, since the movable iron core 48 is displaced between the normal position and the semi-operation position, it is possible to check (inspect) the operation of the actuator 41 without completely actuating the safety stop device 33. Consequently, the wedge 34 and the contact portion 37 can be prevented from coming into contact with the car guide rail 2 when the operation of the actuator 41 is inspected. As a result, the operation can be frequently checked, and wear in the wedge 34 and the contact portion 37 can be prevented. Consequently, it is possible to enhance the reliability of the operation of the actuator 41, and it is also possible to lengthen the life of the safety stop device 33.

In addition, by making the amount of electricity to the second coil 52 less in the inspection mode than in the normal mode, the movable iron core 48 is displaced between the semi-operation position and the normal position, and hence, the actuator 41 can be caused to make the semi-operation with a simple construction, and the operation of the actuator 41 can be readily inspected.

In addition, since the operation inspecting device 68 has the inspection mode feeder circuit 64 for supplying an amount of electricity required for the semi-operation which is less than that required for the full operation to the second coil 52, the inspection mode can be carried out, by only switching the electrical connection to the second coil 52 to the inspection mode feeder circuit 64 without using a complicated mechanism, and thus the operation of the actuator 41 can be readily inspected.

Further, since the inspection mode feeder circuit 64 has the inspection mode capacitor 63 the charge capacity of which is set to be smaller than that of the normal mode capacitor 61, the amount of electricity required for the semi-operation can be supplied to the second coil 52 more reliably.

It should be noted that while in the example described above, the output portion 32 is installed within the control panel 13, the output portion 32 may also be installed in the car 3. In this case, since the safety stop device 33 and the output portion 32 can be installed in the same car 3, it is possible to enhance the reliability of the electrical connection between each of the safety stop devices 33 and the output portion 32. In this case, the battery 12 may also be installed in the car 3.

Also, in the example described above, the position to which the movable iron core 48 is to be automatically recovered is selected after completion of the semi-operation. However, the position where the movable iron core 48 is stopped may be set as the semi-operation position, whereby the movable iron core 48 may be stopped in the semi-operation position and recovered back to the normal position by charging the second coil 52 with electricity in order to be combined with the test as well of the recovery side circuit.

Embodiment 2

Figure 8:
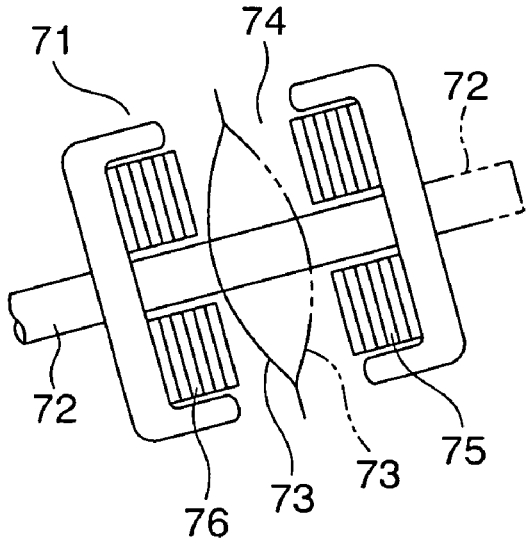
FIG. 8 is a constructional view showing an actuator of the safety stop device according to Embodiment 2 of the present invention.

FIG. 8 is a constructional view showing an actuator of the safety stop device 33 according to Embodiment 2 of the present invention. In this example, an actuator 71 has a rod-like movable portion 72 which is displaceable between an actuator position (solid line) and a normal position (broken line), a disc spring 73 serving as an urging portion mounted to the movable portion 72, and an electromagnet 74 which is adapted to displace the movable portion 72 by an electromagnetic force generated by charging the electromagnet 74 with electricity. The movable portion 72 is fixed to the contact portion mounting member 40 (FIG. 2).

The movable portion 72 is fixed to a central portion of the disc spring 73. The disc spring 73 is deformed by the reciprocating displacement of the movable portion 72. The urging direction of the disc spring 73 is reversed between the actuation position and the normal position by the deformation due to the displacement of the movable portion 72. The movable portion 72 is held in the actuation position and the normal position by the urging of the disc spring 73, respectively. That is, the contact state and separated state of the contact portion 37 (FIG. 2) to and from the car guide rail 2 are held by the urging of the disc spring 73.

The electromagnet 74 has a first electromagnetic portion (first coil) 75 and a second electromagnetic portion (second coil) 76 facing each other. The second electromagnetic portion 76 is fixed to the movable portion 72. The movable portion 72 is displaceable with respect to the first electromagnetic portion 75. The emergency stop wiring 17 is connected to the electromagnet 74.

The first electromagnetic portion 75 and the second electromagnetic portion 76 repel each other on the basis of input of the actuation signal to the electromagnet 74, and attract each other on the basis of input of the recovery signal to the electromagnet 74. The movable portion 72 is displaced together with the electromagnet portion 76 and the disc spring 73 in a direction approaching the actuation position on the basis of the input of the actuation signal to the electromagnet 74, and displaced together with the electromagnet portion 76 and the disc spring 73 in a direction approaching the normal position on the basis of the input of the recovery signal to the electromagnet 74.

It should be noted that a current direction changing switch (not shown) for reversing the direction of charging the first electromagnetic portion 75 with electricity is connected to the feeder circuit 55. As a result, the direction of charging the first electromagnetic portion 75 and the second electromagnetic portion 76 with electricity can be changed during the actuation operation and during the recovery operation. Other construction is the same as that in Embodiment 1.

Next, operation will be described.

The operation until the actuation signal is output from the output portion 32 to each of the safety stop devices 33 is the same as that in Embodiment 1.

When the actuation signal is input to each of the safety stop devices 33, the first electromagnetic portion 75 and the second electromagnetic portion 36 repel each other. The movable portion 72 is displaced to the actuation portion by the electromagnetic repellent force. Along with this displacement, the contact portion 37 is displaced in a direction to come into contact with the car guide rail 2. The urging direction of the disc spring 73 is reversed to the direction of holding the movable portion 72 in the actuation portion by the time the movable portion 72 reaches the actuation portion. As a result, the contact portion 37 comes into contact with the car guide rail 2 to be pressed against the car guide rail 2, thereby braking the wedge 34 and the support mechanism portion 35.

During the recovery operation, the recovery signal is transmitted from the output portion 32 to the electromagnet 48. As a result, the current direction changing switch is manipulated, and the first electromagnetic portion 75 and the second electromagnetic portion 76 attract each other. The movable portion 72 is displaced to the normal position and the contact portion 37 is displaced in a direction to be separated away from the car guide rail 2 through this attraction. The urging direction of the disc spring 73 is reversed and the movable portion 72 is held in the normal position by the time the movable portion 72 reaches the normal position. The operation after this in Embodiment 2 is the same as that in Embodiment 1. Also, the operation inspection method for the actuator 71 is the same as that of Embodiment 1.

Even with the actuator 71 having the construction as described above, the operation of the actuator 71 can be readily inspected and the reliability of the actuator 71 can be enhanced in the same manner as that in Embodiment 1.

Embodiment 3

Figure 9:
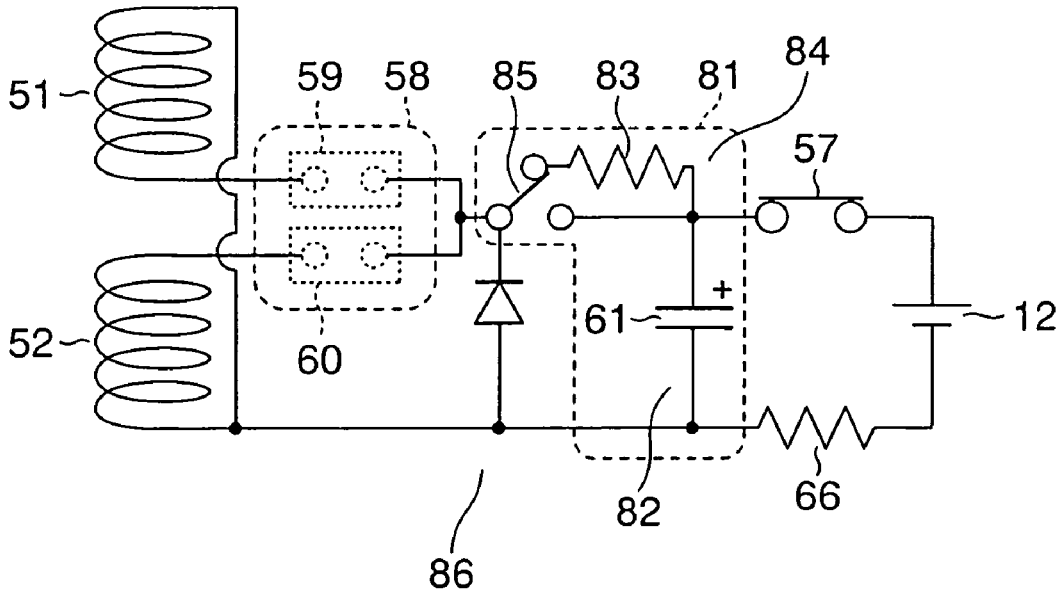
FIG. 9 is a circuit diagram showing a feeder circuit of the elevator apparatus according to Embodiment 3 of the present invention.

FIG. 9 is a circuit diagram showing a feeder circuit of the elevator apparatus according to Embodiment 3 of the present invention. In the drawing, a charge portion 81 has: a normal mode feeder circuit 82 including the same normal mode capacitor 61 as that in each of Embodiments 1 and 2 described above; an inspection mode feeder circuit 84 in which an inspection mode resistor 83 having a predetermined resistance value set in advance is added to the normal mode feeder circuit 82; and a change-over switch 85 which can selectively change the electrical connection to the discharge switch 58 between the normal mode feeder circuit 82 and the inspection mode feeder circuit 84.

In the inspection mode feeder circuit 84, the normal mode capacitor 61 and the inspection mode resistor 83 are connected in series with each other. In addition, the electric power of the battery 12 can be accumulated in the normal mode capacitor 61 by turning ON the charge switch 57. It should be noted that the operation inspecting device 86 has the inspection mode feeder circuit 84. Other constructions in Embodiment 3 are the same as in Embodiment 1.

Next, operation will be described. During normal operation, the charge switch 58 is electrically connected to the normal mode feeder circuit 82 through the change-over switch 85 (normal mode). Operation in the normal mode is the same as that in Embodiment 1.

Next, description will be given with respect to a procedure when the operation of the actuator 41 is inspected, i.e., a method of inspecting the operation of the actuator 41.

First, after the charge switch 57 is turned OFF, the first semiconductor switch 59 is turned ON to discharge the electric power accumulated in the normal mode capacitor 61.

After that, the connection to the discharge switch 58 is changed from the normal mode feeder circuit 82 over to the inspection mode feeder circuit 84. Next, the charge switch 57 is turned ON to accumulate the electric power of the battery 12 in the normal mode capacitor 61. After the charge switch is turned OFF, the second semiconductor switch 60 is turned ON to cause current to flow through the second coil 52. At this time, the inspection mode resistor 83 is connected in series with the normal mode capacitor 61 within the inspection mode feeder circuit 82. Hence, a part of the electrical energy discharged from the normal mode capacitor 61 is consumed in the inspection mode resistor 83, and thus an amount of electricity which is less than that required for the full operation is supplied to the second coil 52.

If the operation of the actuator 41 is normal, the movable iron core 48 is displaced from the normal position to the semi-operation position, and is then pulled back to the normal position again. The contact portion mounting member 40 and the contact portion 37 are also smoothly displaced along this operation. That is, the movable iron core 48 and the contact portion mounting member 40 make the normal semi-operation.

If there is a malfunction in the operation of the actuator 41, the movable iron core 48, the contact portion mounting member 40, and the contact portion 37 do not make the normal semi-operation as described above. The presence or absence of a malfunction in the operation of the actuator 41 is checked in such a manner.

After completion of the inspection, the inspection mode is changed over to the normal mode through the change-over switch 85 and the charge switch 57 is then turned ON, thereby accumulating the electric power of the battery 12 in the normal mode capacitor 61.

With the operation inspection device 86 for the actuator 41 as described above, since the inspection mode resistor 83 adapted to consume a part of the electricity required for the full operation is used, the actuator 41 can be readily caused to make the semi-operation using a resistor which is more inexpensive than a capacitor. In addition, since the capacitor can be made common to the normal mode and the inspection mode, it is possible to reduce the number of components such as the plurality of resistors required with the application of the capacitor. Consequently, the cost can be largely reduced.

Embodiment 4

Figure 10:
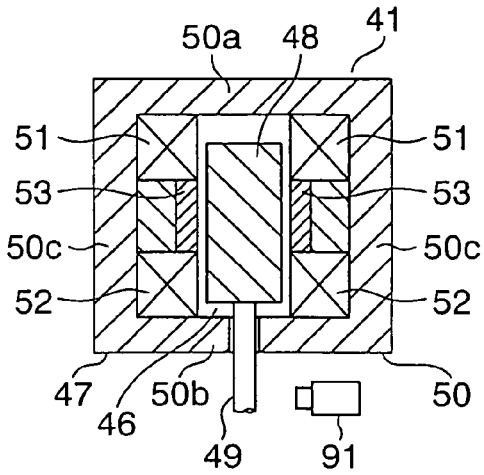
FIG. 10 is a cross sectional view showing an actuator of the safety stop device according to Embodiment 4 of the present invention.

FIG. 10 is a cross sectional view showing an actuator of the safety stop device according to Embodiment 4 of the present invention. In this example, an optical position detecting sensor 91 serving as a detection portion which can detect the displacement of the connection rod 49 is provided in the vicinity of the actuator 41. The position detecting sensor 91 is adapted to be actuated only during the operation inspection not during normal operation. In addition, the position detecting sensor 91 is electrically connected to the output portion 32 (FIG. 1).

When the movable iron core 48 is located in a predetermined position located between the normal position and the semi-operation position, the position detecting sensor 91 detects the connection rod 49. The output of the actuation signal from the output portion 32 is stopped on the basis of the detection of the connection rod 49 by the position detecting sensor 91.

Further, an operation inspecting device 92 has the position detecting sensor 91. In addition, while in Embodiment 1, the inspection mode feeder circuit 64 is used in the feeder circuit 55 (FIG. 6), in Embodiment 4, a feeder circuit is used from which the inspection mode feeder circuit 64 is removed. Other constructions and operations in Embodiment 4 are the same as those in Embodiment 1.

Next, a description will be given with respect to a procedure when the operation of the actuator 41 is inspected, i.e., a method of inspecting the operation of the actuator 41. First, the position detecting sensor 91 is actuated so that it can detect the connection rod 49. After that, the actuation signal is output from the output portion 32 to the safety stop device 33 so that the movable iron core 48 is displaced in a direction approaching the actuation position from the normal position.

When the operation of the actuator 41 is normal, the movable iron core 48 is displaced from the normal position to the semi-operation position. At this time, the output of the actuation signal from the output portion 32 is stopped by the time the movable iron core 48 is displaced to the semi-operation position on the basis of the detection of the connection rod 49 by the position detecting sensor 91. The movable iron core 48 is displaced to the semi-operation position by inertia after this.

After that, the movable iron core 48 is pulled back to the normal position again by the magnetic force of the permanent magnet 53. The contact portion mounting member 40 and the contact portion 37 are also smoothly displaced along with this operation. That is, the movable iron core 48, the contact portion mounting member 40, and the contact portion 37 are caused to make the normal semi-operation.

If there is a malfunction in the operation of the actuator 41, the movable iron core 48, the contact portion mounting member 40, and the contact portion 37 are not caused to make the normal semi-operation as described above. The presence or absence of a malfunction in the operation of the actuator 41 is checked in such a manner.

After completion of the inspection, the operation of the position detecting sensor 91 is stopped.

In the operation inspecting device 92 of the actuator 41 as described above, the displacement of the movable iron core 48 to the semi-operation position is detected by the position detecting sensor 91. Hence, the displacement of the movable iron core 48 to the semi-operation position can be more reliably made.

Embodiment 5

Figure 11:
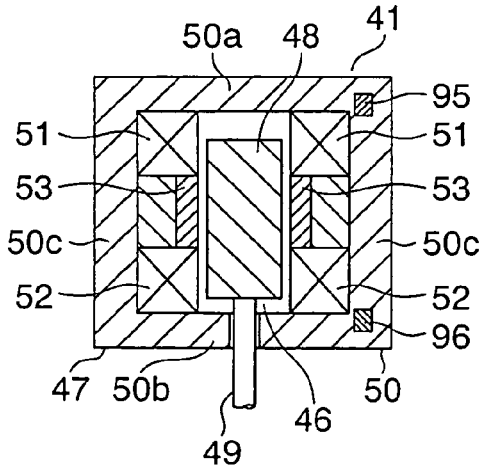
FIG. 11 is a cross sectional view showing an actuator of the safety stop device of the elevator according to Embodiment 5 of the present invention.

FIG. 11 is a cross sectional view showing an actuator of the safety stop device of the elevator according to Embodiment 5 of the present invention. In the example described above, the optical position detecting sensor 91 is used as the detection portion for detecting the position of the movable iron core 48. However, as shown in the drawing, a plurality of magnetic flux sensors 95, 96 may be embedded in the fixed iron core 50, and the magnetic flux within the fixed iron core 50 may be measured by the magnetic flux sensors 95, 96, thereby detecting the position of the movable iron core 48.

The magnetic flux sensor 95 is embedded in one end portion of regulating portion 50*a*, and the magnetic flux sensor 96 is embedded in one end portion of the other regulating portion 50*b*. In addition, the magnetic flux sensors 95, 96 are electrically connected to the output portion 32. Moreover, each of the magnetic flux sensors 95, 96 is constituted by a Hall element.

Figure 12:
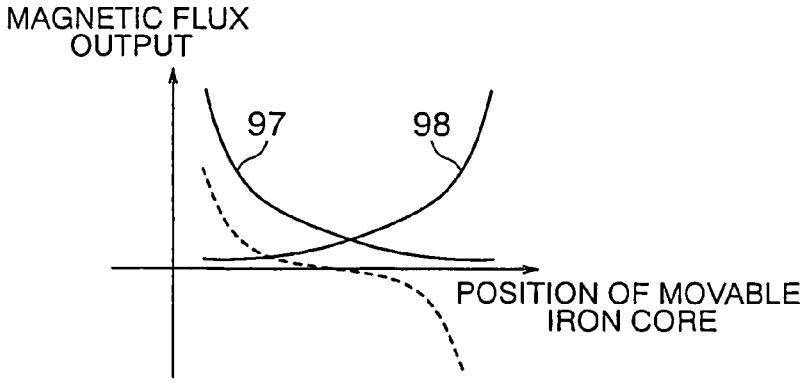
FIG. 12 is a graph showing a relationship between amounts of magnetic flux (solid lines) which are detected by the magnetic flux sensors, respectively, and a difference (broken line) between the amounts of magnetic flux, and position of the movable iron core.

FIG. 12 is a graph showing a relationship between amounts of magnetic flux (solid lines) which are detected by the magnetic flux sensors 95, 96, respectively, and a difference (broken line) between the amounts of magnetic flux, and position of the movable iron core 48. As shown in the drawing, an amount 97 of magnetic flux detected by the magnetic flux sensor 95 (hereinafter referred to as "amount of magnetic flux at one-side") decreases as the movable iron core 48 is displaced from the normal position to the actuation position. An amount 98 of magnetic flux detected by the magnetic flux sensor 96 (hereinafter referred to as "amount of magnetic flux at other-side") increases as the movable iron core 48 is displaced from the normal position to the actuation position. In addition, when the movable iron core 48 is located in the normal position, the amount of magnetic flux at one side 97 is more than that of the magnetic flux at the other side 98. When the movable iron core 48 is located in the actuation position, the amount of magnetic flux at the other side 98 is more than that of the magnetic flux at one side 97. Further, the position of the movable iron core 48 where a difference between the amount of magnetic flux at one side 97 and the amount of magnetic flux at the other side 98 becomes zero is a neutral position.

When the movable iron core 48 is displaced to a preset position, the output portion 32 stops outputting the actuation signal. The set position where the output of the actuation signal is stopped is a position located between the normal position and the neutral position, and also a position (predetermined position) where the movable iron core 48 does not go beyond the neutral position by inertial force. Other constructions and operations in Embodiment 5 are the same as those in Embodiment 4.

Next, a description will be given with respect to a procedure when the operation of the actuator 41 is inspected, i.e., a method of inspecting the operation of the actuator 41. First, the magnetic flux sensors 95, 96 are actuated to provide a state permitting amounts of magnetic flux to be detected by the magnetic flux sensors 95, 96, respectively. After that, the actuation signal is output from the output portion 32 to the safety stop device 33 so that the movable iron core 48 is displaced in a direction approaching the actuation position from the normal position.

If the operation of the actuator 41 is normal, the movable iron core 48 is displaced from the normal position to the semi-operation position. At this time, the output of the actuation signal from the output portion 32 is stopped when the movable iron core 48 is displaced to a predetermined position. The movable iron core 48 is displaced to the semi-operation position the inertia after this.

After that, the movable iron core 48 is pulled back to the normal position again by the magnetic force of the permanent magnet 53. The contact portion mounting member 40 and the contact portion 37 are also smoothly displaced along with this operation. That is, the movable iron core 48, the contact portion mounting member 40, and the contact portion 37 are caused to make the normal semi-operation.

If there is a malfunction in the operation of the actuator 41, the movable iron core 48, the contact portion mounting member 40, and the contact portion 37 are not caused to make the normal semi-operation as described above. The presence or absence of a malfunction in the operation of the actuator 41 is checked in such a manner.

After completion of the inspection, the operation of the magnetic flux sensors 95, 96 are stopped.

In the operation inspecting device of the actuator 41 as described above, the magnetic flux sensors 95, 96 are used as the detection portion for detecting a position of the movable iron core 48. Hence, inexpensive Hall elements can be used, and thus costs can be further reduced.

Further, in the example described above, the position of the movable iron core 48 is determined by obtaining a difference between the amounts of magnetic flux which are detected by the magnetic flux sensors 95, 96, respectively. However, the position of the movable iron core 48 may also be determined by obtaining a ratio between the amounts of magnetic flux which are detected by the magnetic flux sensors 95, 96, respectively. In this case, even when magnetic flux is generated from the first coil 51 and the second coil 52, respectively, it is possible to reduce errors in detection of the position of the movable iron core 48.

Embodiment 6

Figure 13:
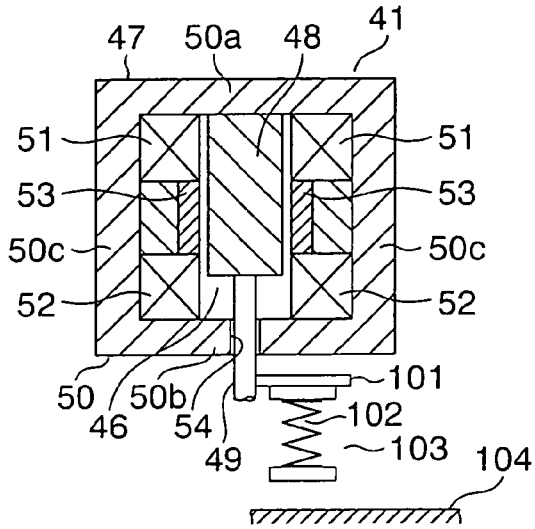
FIG. 13 is a schematic cross sectional view showing an actuator of the safety stop device of the elevator according to Embodiment 6 of the present invention.

FIG. 13 is a schematic cross sectional view showing an actuator of the safety stop device of the elevator according to Embodiment 6 of the present invention. In the drawing, a projection member 101 is fixed to a side face of the connection rod 49. The projection member 101 is provided with a load portion 103 including a spring 102. A facing member (operation target) 104 facing the load portion 103 is fixed to the supporting portion 39 (FIG. 2).

The position of the load portion 103 is adjusted so that when the movable iron core 48 is located in the neutral position, the load portion 103 abuts on the facing member 104. The spring 102 is depressed between the facing member 103 and the projection member 101 by the displacement of the movable iron core 48 in a direction approaching the actuation position from the neutral position to generate an elastic resiliency. That is, the load portion 103 is pressed against the facing member 104 so that the spring 102 is compressed, whereby the load portion 103 generates a drag acting against the displacement of the movable iron core 48 in a direction approaching the actuation position.

Figure 14:
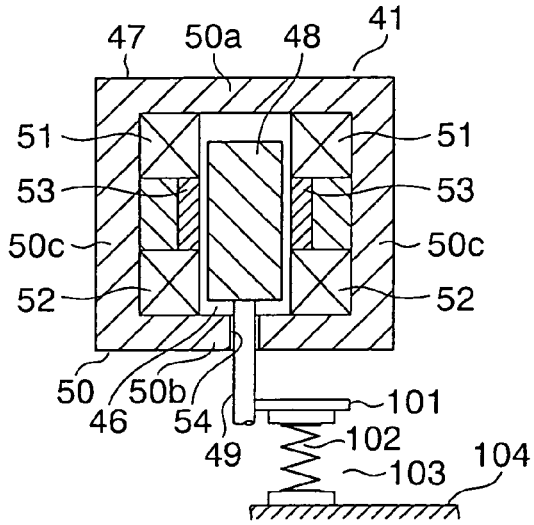
FIG. 14 is a schematic cross sectional view showing a state in which the actuator shown in FIG. 13 is operated during the inspection mode.
Figure 15:
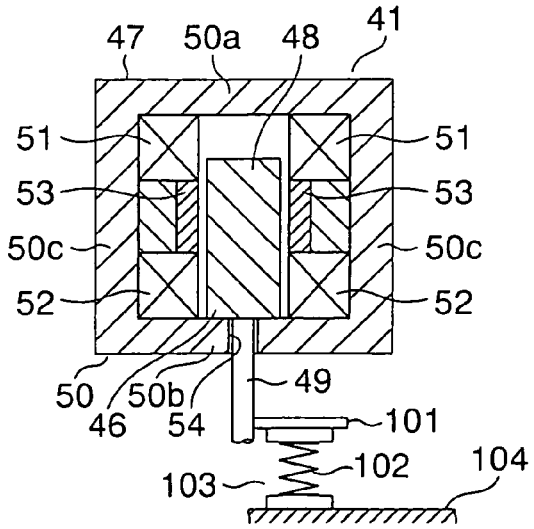
FIG. 15 is a schematic cross sectional view showing a state in which the actuator shown in FIG. 13 is operated during the normal mode.

FIG. 14 is a schematic cross sectional view showing a state in which the actuator 41 shown in FIG. 13 is operated during the inspection mode. Also, FIG. 15 is a schematic cross sectional view showing a state in which the actuator 41 shown in FIG. 13 is operated during the normal mode. As shown in the drawing, during the normal mode, the electromagnetic force which is generated by causing current to flow through the second coil 52 (hereinafter referred to as "second coil 52 electromagnetic force") is smaller than the drag of the load portion 103. Thus, after having been displaced to the semi-operation position, the movable iron core 48 is pushed back to the normal position. During the normal mode, since the second coil 52 electromagnetic force is larger than the drag of the load portion 103, the movable iron core 48 overcomes the drag of the load portion 103 to be displaced to the actuation position.

Figure 16:
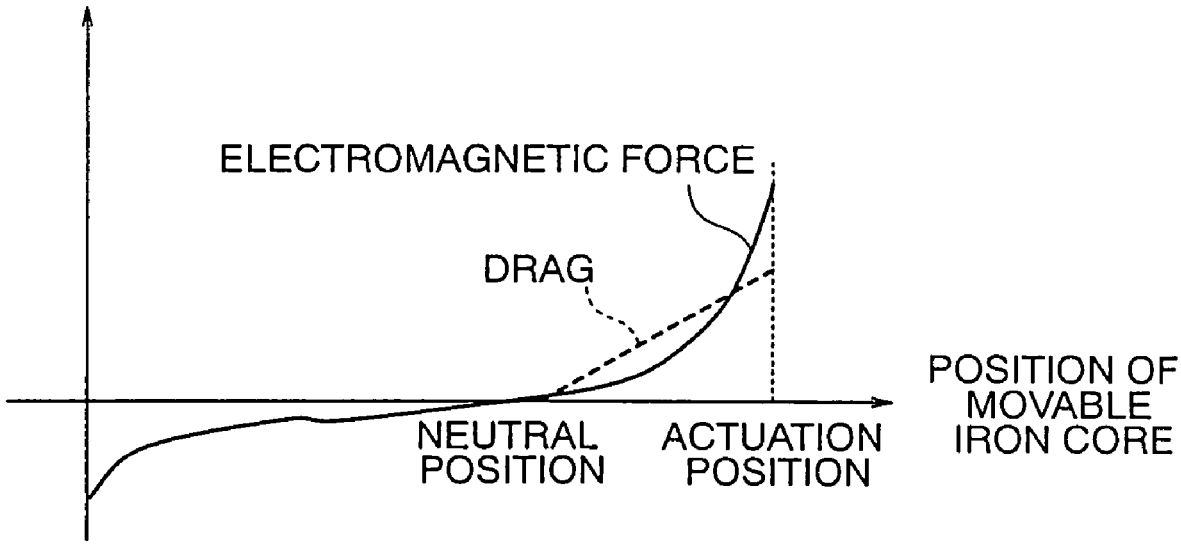
FIG. 16 is a graph showing a relationship between the second coil electromagnetic force (solid line) and the elastic resiliency (broken line) of the spring in FIG. 15, and the position of the movable iron core.

FIG. 16 is a graph showing a relationship between the second coil 52 electromagnetic force (solid line) and the elastic resiliency (broken line) of the spring 102 in FIG. 15, and the position of the movable iron core 48. As shown in the drawing, in any position between the neutral position and the actuation position, when the movable iron core 48 is located on the neutral position side, the second coil 52 electromagnetic force is smaller than the drag of the load portion 103, while when the movable iron core 48 is located on the actuation position side, the second coil 52 electromagnetic force is larger than the drag of the load portion 103. From this fact, the semi-operation position is set in a range in which the magnitude of the second coil 52 electromagnetic force is smaller than that of the drag of the load portion 103. Other constructions and operations in Embodiment 6 are the same as those in Embodiment 1.

With the operation inspecting device of the actuator 41 as described above, the load portion 103 generates the drag acting against the displacement of the movable iron core 48 in the direction for approaching the actuation position. Hence, for example, it is possible to resolve the instability of the operation due to a change in temperature of the feeder circuit 55, a fluctuation in friction between the members, or the like, and thus it is possible to more reliably realize the displacement of the movable iron core 48 between the neutral position and the semi-operation position during the inspection mode.

It should be noted that while in the example described above, the drag is generated by the load portion 103 having the spring 102, the drag may also be generated by a damper.

Embodiment 7

Figure 17:
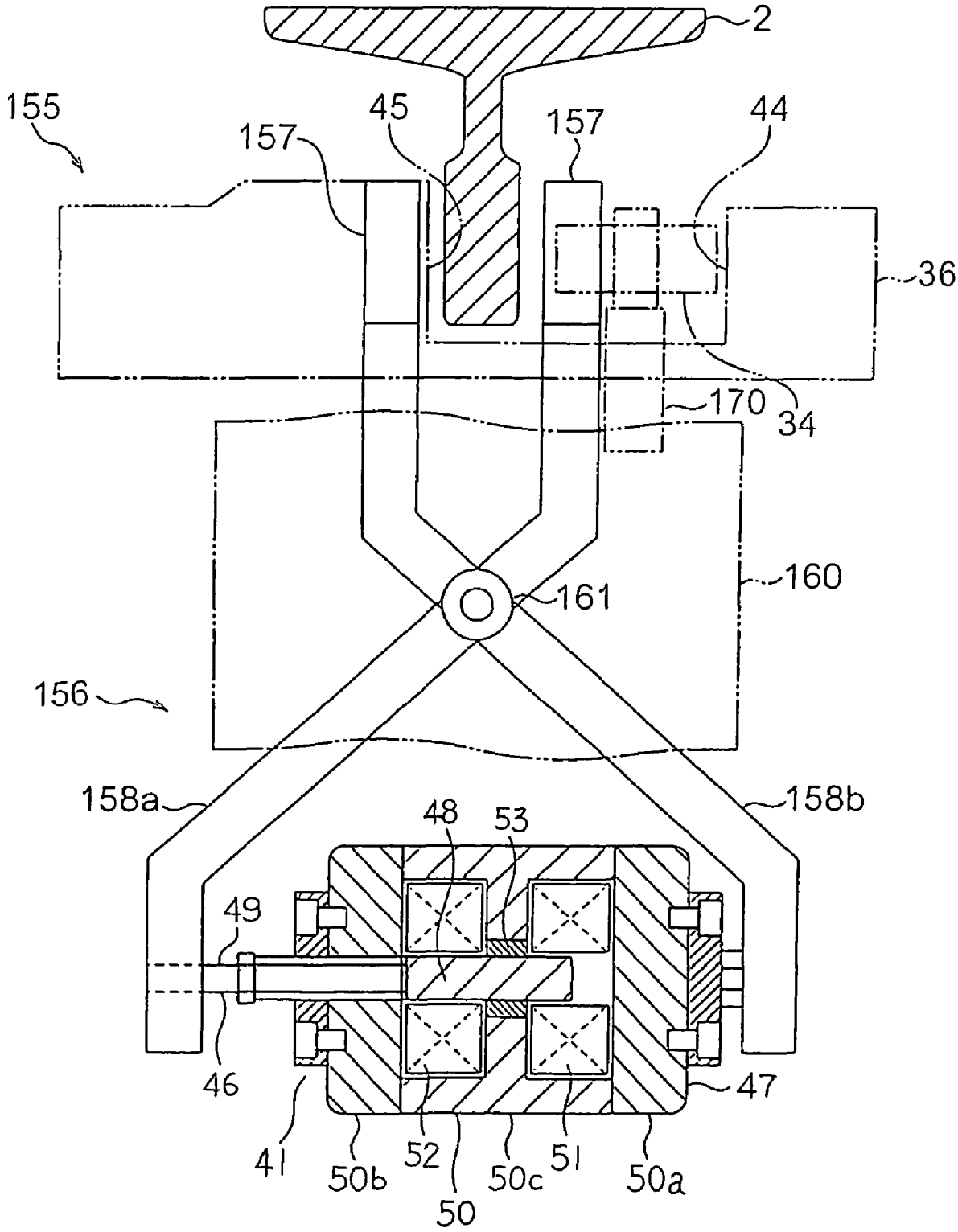
FIG. 17 is a plan view showing a safety device according to Embodiment 7 of the present invention.

FIG. 17 is a plan view showing a safety device according to Embodiment 7 of the present invention. Here, a safety device 155 has the wedge 34, a support mechanism portion 156 connected to a lower portion of the wedge 34, and the guide portion 36 arranged above the wedge 34 and fixed to the car 3. The support mechanism portion 156 is vertically movable with respect to the guide portion 36 together with the wedge 34.

The support mechanism portion 156 has a pair of contact portions 157 capable of moving into and away from contact with the car guide rail 2, a pair of link members 158*a*, 158*b* each connected to one of the contact portions 157, an actuator 41 for displacing the link member 158*a* relative to the other link member 158*b* such that the respective contact portions 157 move into and away from contact with the car guide rail 2, and a support portion 160 supporting the contact portions 157, the link members 158*a*, 158*b*, and the actuator 41. A horizontal shaft 170, which passes through the wedge 34, is fixed to the support portion 160. The wedge 34 is capable of reciprocating displacement in the horizontal direction with respect to the horizontal shaft 170.

The link members 158*a*, 158*b* cross each other at a portion between one end to the other end portion thereof. Further, provided to the support portion 160 is a connection member 161 which pivotably connects the link member 158*a*, 158*b* together at the portion where the link members 158*a*, 158*b* cross each other. Further, the link member 158*a* is provided so as to be pivotable with respect to the other link member 158*b* about the connection member 161.

As the respective other end portions of the link member 158*a*, 158*b* are displaced so as to approach each other, each contact portion 157 is displaced into contact with the car guide rail 2. Likewise, as the respective other end portions of the link member 158*a*, 158*b* are displaced so as to separate away from each other, each contact portion 157 is displaced away from the car guide rail 2.

The actuator 41 is displaced between the respective other end portions of the link members 158*a* and 158*b*. In addition, the actuator 41 is supported by each of the link members 158*a* and 158*b*. Moreover, the connection portion 46 is connected to one link member 158*a*. The fixed iron core 50 is fixed to the other link member 158*b*. The actuator 41 is pivotable together with the link members 158*a* and 158*b* about the connection member 161.

When the movable iron core 48 abuts regulating portion 50*a*, both of the contact portions 157 contact the car guide rail 2, and when the movable iron core 48 abuts the other regulating portion 50*b*, both of the contact portions 157 are separated away from contact with the car guide rail 2. That is, the movable iron core 48 is displaced to the actuation position by displacement in the direction to abut on the regulating portion 50*a*, and displaced to the normal position by the displacement in the direction to abut on the other regulating portion 50*b*. Other construction in Embodiment 7 is the same as that in Embodiment 1.

Next, operation will be described.

The operation by the time the actuation signal is output from the output portion 32 to each of the safety stop device 33 is the same as that in Embodiment 1.

When the actuation signal is input to each of the safety stop devices 33, a magnetic flux is generated around the first coil 51 so that the movable iron core 48 is displaced in the direction approaching the regulating portion 50*a* and thus displaced from the normal position to the actuation position. At this time, the contact portions 157 are displaced in a direction approaching each other to come into contact with the car guide rail 2. As a result, the wedge 34 and the support mechanism portion 156 are braked.

After that, the guide portion 36 continues to lower to approach the wedge 34 and the support mechanism portion 156. As a result, the wedge 34 is guided along the inclined surface 44 so that the car guide rail 2 is held between the wedge 34 and the contact surface 45. After that, the car 3 is braked through the same operations as those in Embodiment 1.

During the recovery phase, a recovery signal is transmitted from the output portion 32 to the second coil 52. As a result, a magnetic flux is generated around the second coil 52 so that the movable iron core 48 is displaced from the actuation position to the normal position. After that, the press contact of the wedge 34 and the contact surface 45 with the car guide rail 2 is released in the same manner as that in Embodiment 1.

The method of inspecting the operation of the actuator 41 is identical to that of Embodiment 1.

In the elevator apparatus as described above, the actuator 41 causes the pair of contact portions 157 to be displaced through the intermediary of the link members 158*a* and 158*b*. Hence, it is possible to reduce the number of actuators 41 required to displace the pair of contact portions 157.

In addition, the actuator 41 can be applied to even the safety stop device 155 of the elevator as described above, and thus the operation of the actuator 41 can be readily inspected in the same manner as that in Embodiment 1. Consequently, the reliability of the actuator 41 can be enhanced. In addition, the life of the actuator can be lengthened.

Embodiment 8

Figure 18:
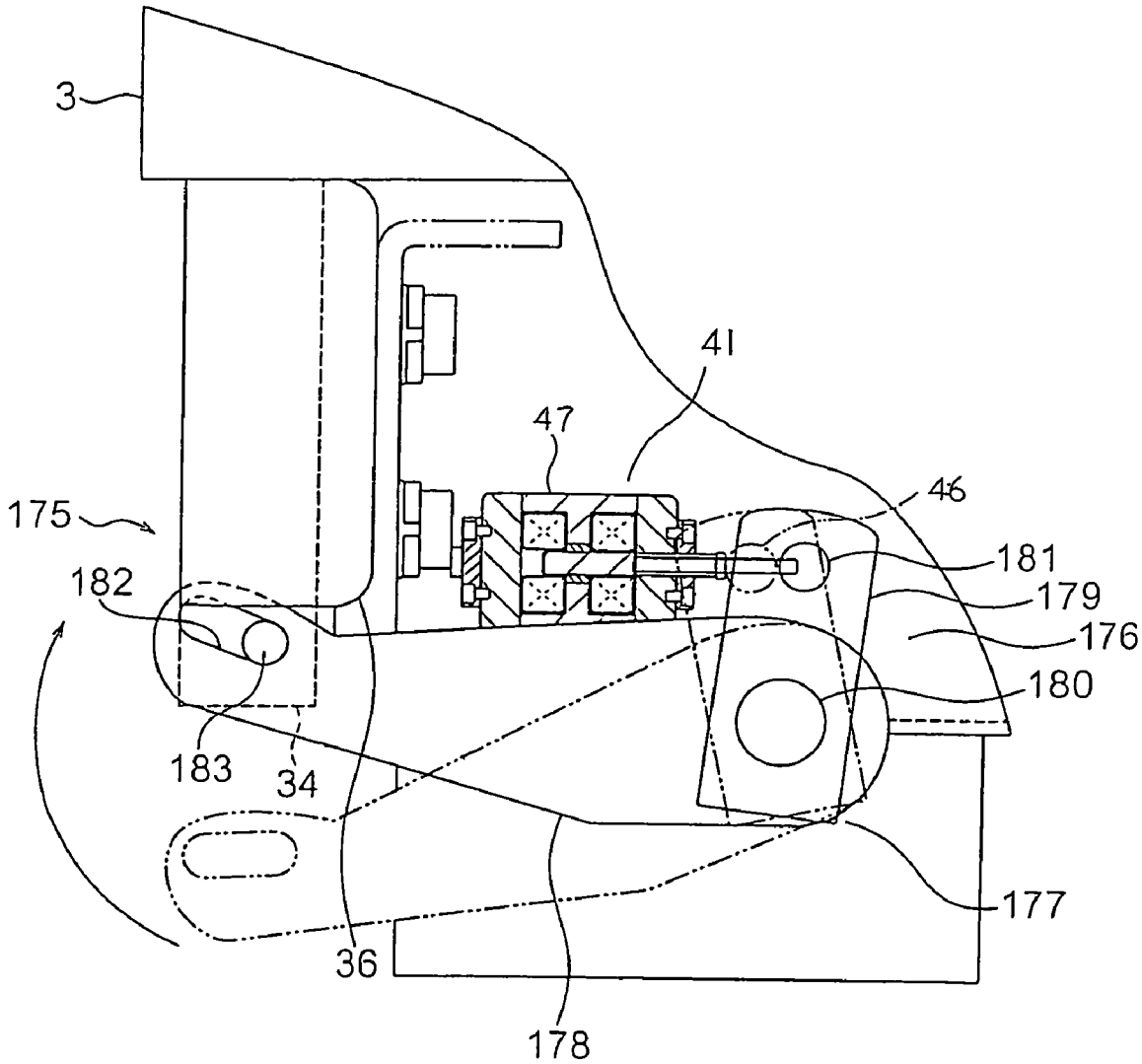
FIG. 18 is a partially cutaway side view showing a safety device according to Embodiment 8 of the present invention.

FIG. 18 is a partially cutaway side view showing a safety device according to Embodiment 8 of the present invention. Referring to FIG. 17, a safety device 175 has the wedge 34, a support mechanism portion 176 connected to a lower portion of the wedge 34, and the guide portion 36 arranged above the wedge 34 and fixed to the car 3.

The support mechanism portion 176 has the actuator 41 constructed in the same manner as that of Embodiment 1, and a link member 177 displaceable through displacement of the connection portion 46 of the actuator 41.

The actuator 41 is fixed to a lower portion of the car 3 so as to allow reciprocating displacement of the connection portion 46 in the horizontal direction with respect to the car 3. The link member 177 is pivotably provided to a stationary shaft 180 fixed to a lower portion of the car 3. The stationary shaft 180 is arranged below the actuator 41.

The link member 177 has a first link portion 178 and a second link portion 179 which extend in different directions from the stationary shaft 180 taken as the start point. The overall configuration of the link member 177 is substantially a prone shape. That is, the second link portion 179 is fixed to the first link portion 178, and the first link portion 178 and the second link portion 179 are integrally pivotable about the stationary shaft 180.

The length of the first link portion 178 is larger than that of the second link portion 179. Further, an elongate hole 182 is provided at the distal end portion of the first link portion 178. A slide pin 183, which is slidably passed through the elongate hole 182, is fixed to a lower portion of the wedge 34. That is, the wedge 34 is slidably connected to the distal end portion of the first link portion 178. The distal end portion of the connection portion 46 is pivotably connected to the distal end portion of the second link portion 179 through the intermediation of a connecting pin 181.

The link member 177 is capable of reciprocating movement between a normal position where it keeps the wedge 34 separated away from and below the guide portion 36 and an actuating position where it causes the wedge 34 to wedge in between the car guide rail and the guide portion 36. The connection portion 46 is projected from the drive portion 163 when the link member 177 is at the normal position, and it is retracted into the drive portion 163 when the link member is at the actuating position. Other constructions in Embodiment 8 are the same as in Embodiment 1.

Next, operation is described. During normal operation, the link member 177 is located at the normal position due to the retracting motion of the connection portion 46 into the drive portion 163. At this time, the wedge 34 is maintained at a spacing from the guide portion 36 and separated away from the car guide rail.

Thereafter, in the same manner as in Embodiment 1, an actuation signal is output from the output portion 32 to each safety device 175, causing the connection portion 46 to advance. As a result, the link member 177 is pivoted about the stationary shaft 180 for displacement into the actuating position. This causes the wedge 34 to come into contact with the guide portion 36 and the car guide rail, wedging in between the guide portion 36 and the car guide rail. Braking is thus applied to the car 3.

During the recovery phase, a recovery signal is transmitted from the output portion 32 to each safety device 175, causing the connection portion 46 to be urged in the retracting direction. The car 3 is raised in this state, thus releasing the wedging of the wedge 34 in between the guide portion 36 and the car guide rail.

The method of inspecting the operation of the actuator 41 is identical to that of Embodiment 1.

Further, the actuator 41 can be applied to even the safety stop device 175 of the elevator as described above, and thus the operation of the actuator 41 can be readily inspected in the same manner as that in Embodiment 1. Consequently, the reliability of the actuator 41 can be enhanced. In addition, the life of the actuator 41 can be lengthened.

Embodiment 9

Figure 19:
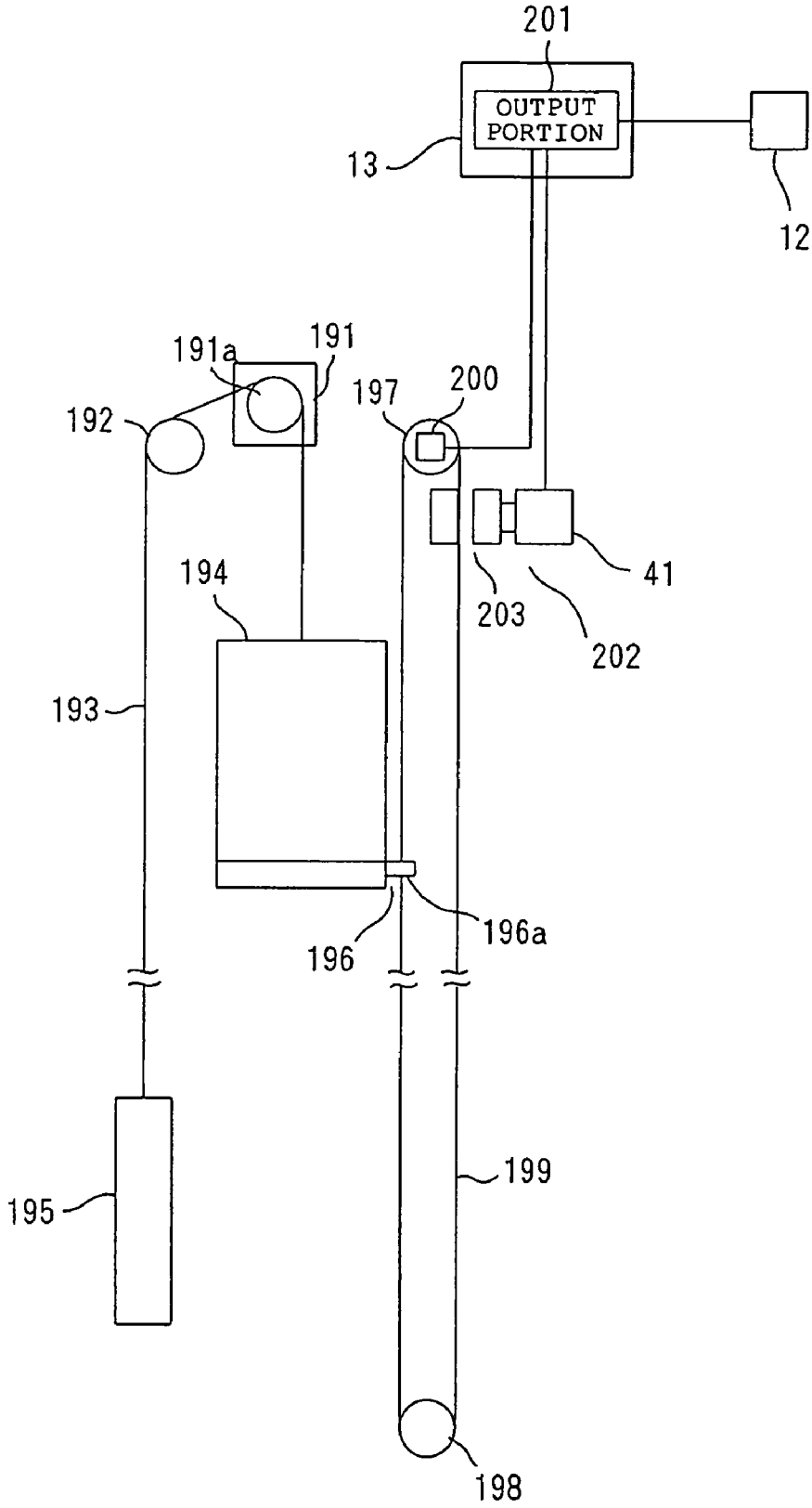
FIG. 19 is a constructional view showing an elevator apparatus according to Embodiment 9 of the present invention.

FIG. 19 is a constructional view showing an elevator apparatus according to Embodiment 9 of the present invention. A driving device (hoisting machine) 191 and a deflector sheave 192 are provided in an upper portion within a hoistway. A main rope 193 is wrapped around a driving sheave 191*a* of the driving device 191 and the deflector 192. A car 194 and a counterweight 195 are suspended in the hoistway by means of the main rope 193.

A mechanical safety stop device 196 which is engaged with a guide rail (not shown) in order to stop the car 194 in case of emergency is installed in a lower portion of the car 194. A speed governor sheave 197 is disposed in the upper portion of the hoistway. A tension sheave 198 is disposed in a lower portion of the hoistway. A speed governor rope 199 is wrapped around the speed governor sheave 197 and the tension sheave 198. Both end portions of the speed governor rope 199 are connected to an actuator lever 196*a* of the safety stop device 196. Consequently, the speed governor sheave 197 is rotated at a speed corresponding to a running speed of the car 194.

The speed governor sheave 197 is provided with a sensor 200 (e.g., an encoder) for outputting a signal used to detect the position and a speed of the car 194. The signal from the sensor 200 is input to the output portion 201 installed in the control panel 13.

A speed governor rope holding device 202 for holding the speed governor rope 199 to stop its circulation is provided in the upper portion of the hoistway. The speed governor rope holding device 202 has a hold portion 203 for holding the speed governor rope 199, and an actuator 41 for driving the hold portion 203. The construction of the actuator 41 is the same as that of the actuator 41 in Embodiment 1.

When the actuation signal from the output portion 201 is input to the speed governor rope holding device 202, the hold portion 203 is displaced by the driving force of the actuator 41 to stop the movement of the speed governor rope 199. When the movement of the speed governor rope 199 is stopped, the actuation lever 196*a* is manipulated by the movement of the car 194, and the safety stop device 196 is then operated to stop the car 194.

In this way even with such an elevator apparatus that inputs the actuation signal from the output portion 201 to the speed governor rope holding device 202 utilizing the electromagnetic drive system, the operation of the actuator 41 applied to the speed governor rope holding device 202 can be inspected in the same manner as that in Embodiment 1. Consequently, the reliability of the actuator 41 can be enhanced. In addition, the life of the actuator 41 can also be lengthened.

It should be noted that while in each of embodiments described above, electrical cable is used as the transmission means for supplying therethrough the electric power from the output portion to the safety stop device, a wireless communication device having a transmitter provided in the output portion and a receiver provided in the safety stop device may also be used instead. Alternatively, an optical fiber cable for transmitting therethrough an optical signal may also be used.

Moreover, in each of embodiments described above, the safety stop device applies braking when the car overspeeds in the downward direction. However, the safety stop device may also apply braking when the car overspeeds in the upward direction by using the safety stop device fixed upside down to the car.

The invention claimed is:

1. A method of inspecting actuator operation for an actuator having a movable portion displaceable between a full actuation position where a safety stop device of an elevator is fully actuated and a normal position where the actuation of the safety stop device is released, comprising:

initiating an inspection mode of the actuator;

displacing, while in the inspection mode, the movable portion from the normal position to a semi-operation position located between the normal position and the full actuation position;

maintaining the movable portion at the semi-operation position while inspecting the actuator without causing the movable portion to move to the full actuation position; and causing the movable portion to move from the semi-operation position to the normal position without causing the movable portion to move to the full actuation position.

2. The method of inspecting actuator operation according to claim 1, wherein the actuator further has an electromagnetic coil for displacing the movable portion when a current flows through the electromagnetic coil, and the displacing includes adjusting an amount of current that flows to the electromagnetic coil.

3. A device for inspecting an operation of an actuator having a movable portion displaceable between a full actuation position where a safety stop device of an elevator is actuated and a normal position where the actuation of the safety stop device is released, and an electromagnetic coil for displacing the movable portion by causing a current to flow through the electromagnetic coil, the device comprising:

a feeder circuit that supplies an amount of electricity required for a semi-operation, in which the movable portion is displaced from the normal position to a semi-operation position located between the normal position and the full actuation position, to the electromagnetic coil, the amount of electricity required for the semi-operation being less than that required for a full operation for displacing the movable portion from the normal position to the full actuation position; and a controller that causes the feeder circuit to maintain the movable portion at the semi-operation until the controller issues a command that causes the feeder circuit to cause the movable portion to return to the normal position without causing the movable portion to move to the full actuation position.

4. The device for inspecting actuator operation according to claim 3, wherein the feeder circuit includes a capacitor that supplies the amount of electricity required for the semi-operation to the electromagnetic coil.

5. The device for inspecting actuator operation according to claim 4 , further comprising a load portion that generates a drag acting against displacement of the movable portion in a direction approaching the full actuation position.

6. The device for inspecting actuator operation according to claim 3, wherein the feeder circuit includes a resistor that consumes a part of the amount of electricity required for the full operation.

7. The device for inspecting actuator operation according to claim 6, further comprising a load portion that generates a drag acting against displacement of the movable portion in a direction approaching the full actuation position.

8. The device for inspecting actuator operation according to claim 3, further comprising a detection portion that detects displacement of the movable portion to a semi-operation position located between the full actuation position and the normal position.

9. The device for inspecting actuator operation according to claim 5, further comprising a load portion that generates a drag acting against displacement of the movable portion in a direction approaching the full actuation position.

10. The device for inspecting actuator operation according to claim 3, further comprising a load portion that generates a drag acting against displacement of the movable portion in a direction approaching the full actuation position.

11. A device for inspecting an operation of an actuator having a movable portion displaceable between an actuation position where a safety stop device of an elevator is actuated and a normal position where the actuation of the safety stop device is released, and an electromagnetic coil for displacing the movable portion by causing a current to flow through the electromagnetic coil, the device comprising:

a feeder circuit for supplying an amount of electricity required for a semi-operation, in which the movable portion is displaced from the normal position to a semi-operation position located between the normal position and the actuation position, to the electromagnetic coil, the amount of electricity required for the semi-operation being less than that required for a full operation for displacing the movable portion from the normal position to the actuation position, wherein the feeder circuit includes, an inspection mode capacitor configured to supply the amount of electricity required for the semi-operation, a normal mode capacitor configured to supply the amount of electricity required for full operation, and a switching device configured to switch between connecting the inspection mode capacitor and the normal mode capacitor to the electromagnetic coil.

12. A device for inspecting an operation of an actuator having a movable portion displaceable between an actuation position where a safety stop device of an elevator is actuated and a normal position where the actuation of the safety stop device is released, and an electromagnetic coil for displacing the movable portion by causing a current to flow through the electromagnetic coil, the device comprising:

a feeder circuit for supplying an amount of electricity required for a semi-operation, in which the movable portion is displaced from the normal position to a semi-operation position located between the normal position and the actuation position, to the electromagnetic coil, the amount of electricity required for the semi-operation being less than that required for a full operation for displacing the movable portion from the normal position to the actuation position, wherein the feeder circuit includes, a capacitor, a switch configured to connect the capacitor to the electromagnetic coil for the full operation for displacing the movable portion from the normal position to the actuation position, and a resistor, wherein the switch is further configured to connect the resistor and the capacitor in series and to connect the resistor to the electromagnetic coil to supply the amount of electricity required for the semi-operation, the resistor consuming a part of the amount of electricity required for the full operation so the electromagnetic coil is supplied with the amount of electricity required for the semi-operation which is less than that required for the full operation.

13. A method of inspecting actuator operation for an actuator having a movable portion displaceable between a full actuation position where a safety stop device of an elevator is actuated and a normal position where the actuation of the safety stop device is released, comprising:

displacing the movable portion between the normal position and a semi-operation position located between the normal position and the full actuation position, wherein the actuator further has an electromagnetic coil for displacing the movable portion when a current flows through the electromagnetic coil, where the movable portion is displaced between the semi-operation position and the normal position by adjusting an amount of current to the electromagnetic coil wherein the displacing includes, discharging a normal mode capacitor, included in a feeder circuit, configured to supply an amount of current required for the full actuation position, charging an inspection mode capacitor, included in the feeder circuit, configured to supply the amount of current required for the semi-operation position, operating a switching device that switches between connecting the inspection mode capacitor and the normal mode capacitor the electromagnetic coil, and discharging the inspection mode capacitor through the electromagnetic coil to displace the movable portion to the semi-operation position.

14. A method of inspecting actuator operation for an actuator having a movable portion displaceable between a full actuation position where a safety stop device of an elevator is actuated and a normal position where the actuation of the safety stop device is released, comprising:

displacing the movable portion between the normal position and a semi-operation position located between the normal position and the full actuation position, wherein the actuator further has an electromagnetic coil for displacing the movable portion when a current flows through the electromagnetic coil, where the movable portion is displaced between the semi-operation position and the normal position by adjusting an amount of current to the electromagnetic coil wherein the displacing includes, charging a capacitor included in a feeder circuit, disengaging the capacitor, with a switching device included in the feeder circuit, from the electromagnetic coil, connecting a resistor to the capacitor in series with the switching device, and connecting, with the switching device, the resistor and the capacitor to the electromagnetic coil to supply the amount of current required for the semi-operation position, the resistor consuming a part of the amount of current required for full actuation position so the electromagnetic coil is supplied with the amount of current required for the semi-operation position which is less than that required for the full actuation position.

* * * * *